United States Patent [19]

Branyon et al.

[11] Patent Number: 4,915,787

[45] Date of Patent: Apr. 10, 1990

[54] PAPER MACHINE SUCTION ROLL SEAL STRIPS

[75] Inventors: William R. Branyon, Landrum; David M. Cline; William B. Richmond, both of Greenville, all of S.C.

[73] Assignee: The Cline Company, Inc., Greenville, S.C.

[21] Appl. No.: 238,283

[22] Filed: Aug. 30, 1988

[51] Int. Cl.[4] ..... D21F 3/10

[52] U.S. Cl. ..... 162/199; 162/217; 162/369; 162/371; 277/193; 277/199

[58] Field of Search ..... 162/369, 371, 199, 217; 277/117, 119, 120, 190, 192, 193, 199

[56] References Cited

U.S. PATENT DOCUMENTS

| | | | |
|---|---|---|---|
| 1,017,674 | 2/1912 | King | 277/199 |
| 1,502,524 | 7/1924 | Price, Jr. | 277/199 |
| 2,714,839 | 2/1951 | Mazer | 162/369 |
| 2,911,042 | 11/1959 | Justus | 162/371 |
| 2,968,505 | 1/1961 | Scaramucci | 277/199 |
| 3,231,289 | 1/1966 | Carrell | 277/199 |
| 3,738,670 | 6/1973 | Jelinek et al. | 277/199 |
| 3,991,455 | 11/1976 | Bergeron | 277/193 |
| 4,426,087 | 1/1984 | Sargent et al. | 277/199 |
| 4,714,523 | 12/1987 | Sawyer, Jr. et al. | 162/371 |

FOREIGN PATENT DOCUMENTS 82661 2/1935 Sweden .

*Primary Examiner*—Richard V. Fisher
*Assistant Examiner*—Christopher Upton
*Attorney, Agent, or Firm*—Cort Flint

[57] ABSTRACT

A sealing strip and joint for a papermaking machine suction roll is disclosed which includes in combination a stationary suction box and a perforated cylindrical shell which rotates around the stationary suction box disposed centrally within the cylindrical shell. The suction box includes slots constructed near at least two outside edges of the suction box extending across the width of the suction box. A composite seal strip extends throughout the width of each slot which includes a plurality of elongated seal strips jointed together end-to-end in the slots. A plurality of joints are spaced along the length of the composite sealing strip defined by ends of adjacent seal strips joined together. The joints include a first end section of a first strip and a second end section of a second strip mated together in an abutting relation. The first end section and second end section have interfitted radius surfaces which mate against each other against the rotation of said cylindrical shell. Planar joint surfaces interconnect the radius surfaces of the first and second end sections of the interfitted ends accommodating thermal expansion of the individual seal strips in the composite strip in a linear direction.

14 Claims, 3 Drawing Sheets

PAPER MACHINE SUCTION ROLL SEAL STRIPS

BACKGROUND OF THE INVENTION

The invention relates generally to seal strips for a suction roll in a papermaking machine in which the seal strips are each constructed from a plurality of individual strips joined together uniquely constructed in regards to the material and the ends of the individual strips which form a joint between the strips.

In the art of papermaking, various machines and steps are provided for forming paper webs beginning from a pulp slurry where one machine is commonly referred to as a fourdrinier machine. The papermaking machine typically includes a suction roll having a stationary suction box disposed centrally and internally of a perforated shell which is rotatably supported and rotates about the suction box. A vacuum source is connected to the suction box which draws the water or steam through the papermaking screen and perforated cylindrical shell for removal. The edges of the vacuum box are sealed against the rotating inside diameter of the cylindrical shell. Slot-like structures are typically formed along at least the two outside edges of the vacuum box for holding seal strips such as shown in U.S. Pat. Nos. 4,714,523 and 2,714,839. The suction boxes range in length up to 34 feet. Prior seal strips have been provided in lengths equal to the length of the suction box. However, this has provided considerable difficulties in shipping the seal strips, particularly overseas. These seal strips have been manufactured mainly by an extrusion process where a seal strip is extruded having a length corresponding to the length of the suction box slot. As a result of the problems of shipping seal strips of a great length, the extruded seal strips have been cut into sections. The shorter sections may be packaged and shipped more conveniently. However, cutting the extruded seal strips into sections has resulted in considerable sealing problems at the ends of the sections which must be joined together end to end across the length of the suction box slot. Prior seal strips have been cut with square cut ends to form a flat abutting surface, and have also been cut at an angle. The angular cut has several problems, one including a tendency of adjoining sealing strips to ride past each other. The square cut joints often do not seal well. Another problem with the prior suctional seal strips is that the edges of the joints, particularly from cutting, often chip and break resulting in deterioration in the sealing of the joint.

Sectional sealing gaskets with interfitted joints are known such as disclosed in U.S. Pat. Nos. 3,738,670 and 3,231,289. In addition, it has been known to utilize joints, including curved hooks, in rod packings such as disclosed in U.S. Pat. Nos. 1,502,524 and 1,017,674. However, these uses and structures are not compatible in the joining together of longitudinal strips in a papermaking machine environment.

Accordingly, an important object of the invention is to provide a seal strip for a papermaking machine suction roll which may be joined together with other seal strips to form a composite seal strip throughout the entire width of a suction box slot of the suction roll which has good wear characteristics as a seal against the rotating surface of a perforated cylindrical shell and also has good sealing characteristics at the joints between the individual seal strips joined together across the slot.

Another object of the invention is to provide a seal strip for a papermaking machine suction box which may be joined together by other seal strips to form a composite seal strip of greater length across the full width of a suction box wherein the seal strip is molded and includes uniquely formed ends which form a highly effective seal between the seal strips.

Another object of the present invention is to provide a seal strip which may be joined together with other seal strips to form a composite seal strip of greater length throughout the entire width of a papermaking machine suction box slot which is molded and which the ends are uniquely constructed to form an effective seal between the seal strips and reduce breakage of the ends of the seal strips to maintain the integrity of the sealed joint.

SUMMARY OF THE INVENTION

The above objectives are accomplished according to the present invention by providing a composite seal in the slot structure of a papermaking machine suction roll consisting of a plurality of individual elongated rectangular seal strips joined end-to-end throughout the width of the slots. The ends are joined by a unique joint wherein interfitting convex and concave surfaces with a prescribed radius of curvature, and a planar interconnecting surface mate together. The mating surfaces span a distance from the bottom of the suction box slot, above the slot wall edges, to an interior surface of a rotating perforated cylindrical shell. The forces from the rotating shell against the joint is distributed widely over the mating surfaces to minimize point stresses which, together with the interfitted radius, reduces joint breakages. The interfitted ends also reduce the tendency of the seal strip ends to slip past one another and accommodate thermal expansion in an opposite linear direction.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
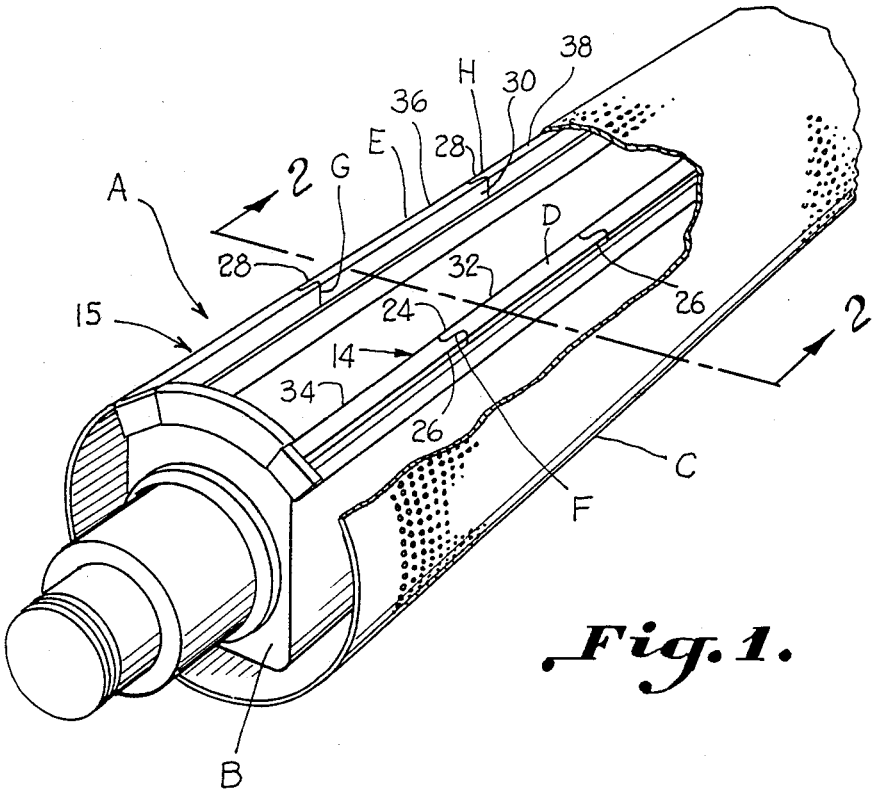
FIG. 1 is a perspective view of a suction box incorporating seal strips and joints according to the present invention.
Figure 2:
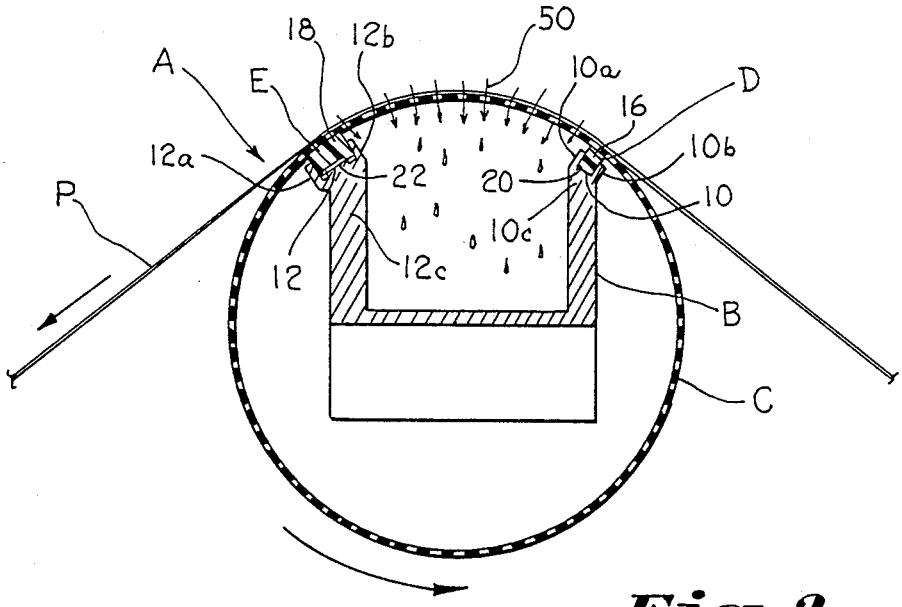
FIG. 2 is a sectional view taken along line 2—2 of FIG. 1.
Figure 3:
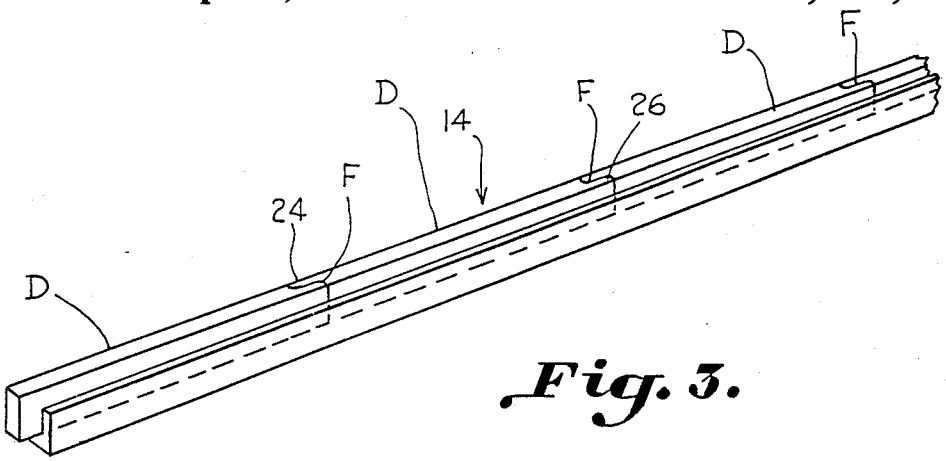
FIG. 3 is a sectional view showing a plurality of seal strips and joints constructed according to the invention joined together end to end.
Figure 4:
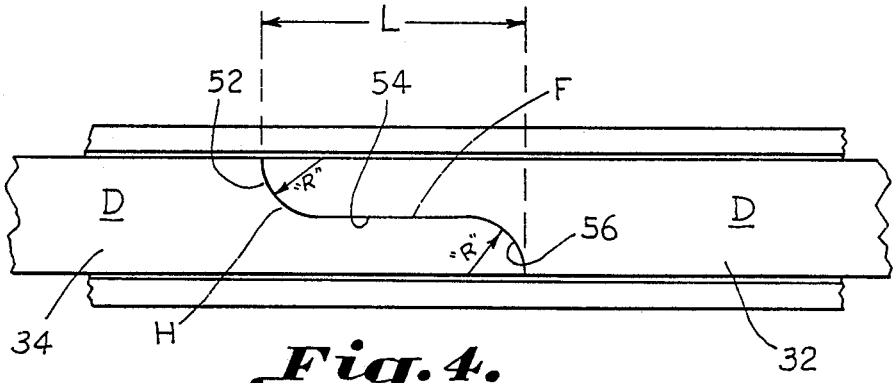
FIG. 4 is an enlarged elevation illustrating a joint for a papermaking machine suction box seal strip according to the invention.
Figure 5:
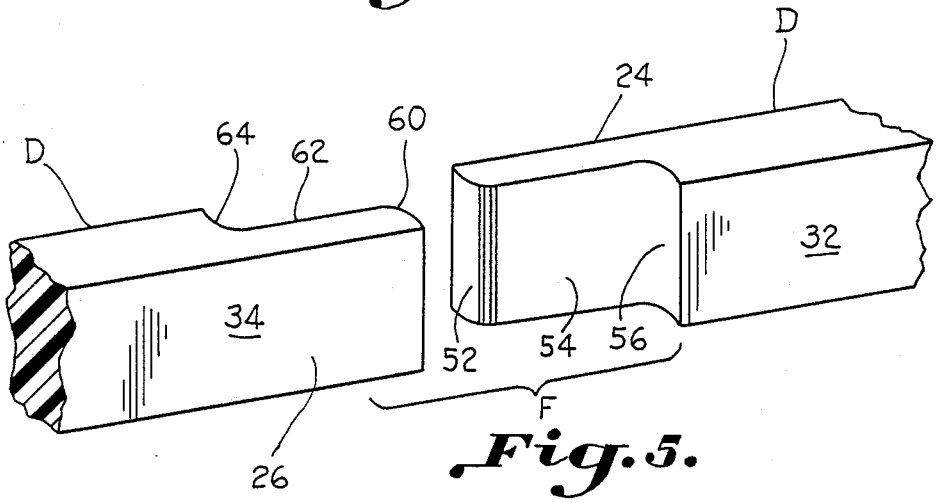
FIG. 5 is a perspective view illustrating two ends of adjoining seal strips of a papermaking machine suction box constructed according to the present invention.
Figure 6:
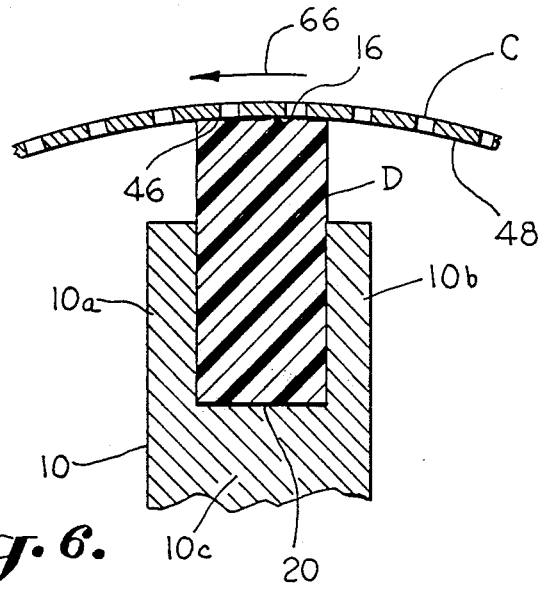
FIG. 6 is an enlarged sectional view of a papermaking machine suction roll seal strip and slot according to the invention.

Referring now in more detail to the drawings, a papermaking machine suction roll, designated generally at A, includes, a stationary suction box B and a perforated cylindrical shell C which rotates around the stationary suction box disposed centrally within the cylindrical shell. The suction box includes slots 10 and 12 constructed near at least two outside edges of suction box B extending across the width of the suction box. Slots 10 and 12 includes a pair of spaced apart opposing slot walls 10*a*, 10*b*, and 12*a*, 12*b* and integral bottom structure 10*c* and 12*c*.

A composite seal strip, designated generally as 14 and 15, of considerable length, extends throughout the width of slots 10 and 12, respectively. A plurality of elongated seal strips D and E are included in the composite seal strip joined together end-to-end in the slots 10 and 12 respectfully. Strips D and E are received in the respective slots in an upstanding manner having an upper wear surface 16 and 18 sealing against rotating cylindrical shell C and a lower support surface 20 and 22 received in the slot. Each strip D has a first end section 24 and a second end section 26. Each strip E has a first end section 28 and a second end section 30. A plurality of joints F and G are spaced along the length of the composite sealing strips 14 and 15 defined by ends of adjacent seal strips joined together. Each joint F includes a first end section 24 of a first strip 32 and a second end section 26 of a second strip 34 mated together in an abutting relation. Joints G includes first end section 28 of a first strip 38 and a second end section 30 of a second strip 36. The first end sections 24, 28 and second end sections 26, 30 of each strip have interfitting radius surfaces H which interfit against each other against rotation of cylindrical shell C in a manner that said interfitted radius surfaces are urged together. Preferably, the individual seal strip D and E and the first and second end sections defining the joint structure are molded.

Figure 7:
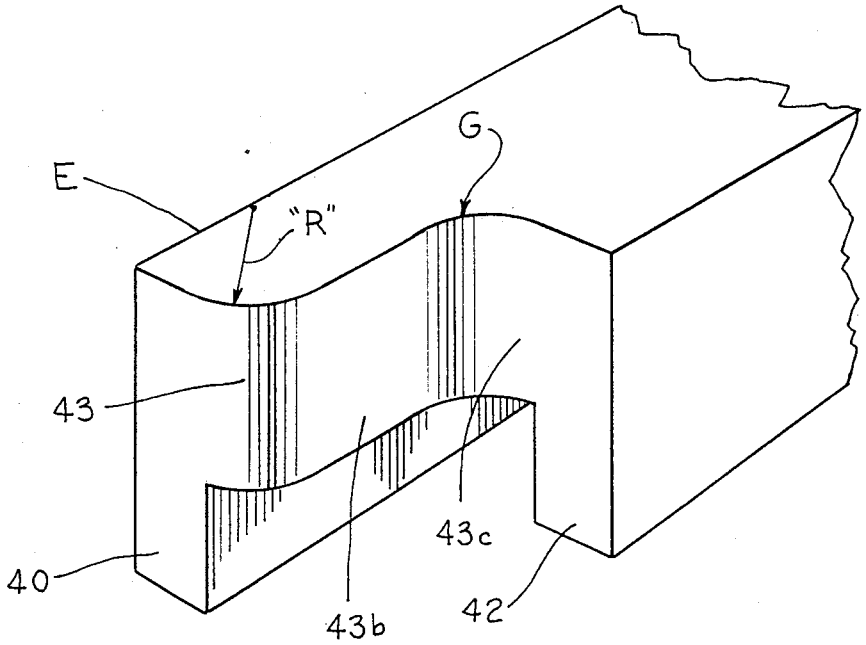
FIG. 7 is a partial perspective view of a seal strip joint according to the invention.

It will be noted that seal strips E are wider than seal strips D. This is typical since seal strip D is used as a silencing strip to reduce chatter and other noises as cylindrical shell C rotates around stationary suction box B. For this reason, seal strips E may have a slightly different construction than seal strips D. Seal strips E normally stand on a pair of legs 40 and 42 instead of being solid as opposed to sealing strip D. The first and second end sections are identical mirror-inverted images of each other. Accordingly, only a first end section 28 will be described in detail in reference to FIG. 7. There is a convex surface 43, a concave surface 43*c*, and a planar joint surface 43*b* which accommodate thermal expansion.

The invention will now be described in detail in reference to seal strips D and joints F, it being understood that the description and invention applies as well to strip E and joints G. Each strip D includes an elongated generally rectangular strip having a length greater than a height, and the height being greater than a width of the rectangular strip. The rectangular strip has lower edge 20 on which the strip stands in slot 1 with the height of the strip extending upwardly past the ends of the slot walls 10*a* and 10*b* and terminating in upper wear edge 46 having a wear surface 16 which engages an interior surface 48 of rotating cylindrical shell C to form a seal for effective suction of fluid 50 through the perforated cylindrical shell into the suction box. Joint F includes a first end section 24 of first strip 32 and second end section 26 of second strip 34 in adjoining relation. First end section 24 includes a first convex surface 52 having a prescribed radius of curvature "R", a first planar joint face 54 generally parallel to slot walls of the suction box integral with first convex surface 52, and a first concave surface 56 having a prescribed radius of curvature "R" integral with first planar surface 54. Second end section 26 includes a second convex surface 60 having a prescribed radius of curvature "R" formed, a second planar face 62 generally parallel to the slot walls of the suction box integral with the second convex surface, and a second concave surface 64 having a prescribed radius of curvature "R" integral with second planar surface 62. The joint includes first and second convex surfaces 52 and 60 mated with second and first concave surfaces 64 and 56, respectively, and first and second planar surfaces 54 and 62 mated together. It is noted that the first and second mated convex surfaces 52, 60, concave surfaces 56, 64, and planar surfaces 54, 62 of the joints have a height extending generally from lower edge 20 to upper wear surface 16 of seal strip D above slot walls 10*a* and 10*b* defining enlarged joint bearing surfaces. The enlarged surfaces bear and mate against one another in reaction and opposition to the rotation of said cylindrical shell in the direction of arrow 66 to maintain the integrity of the joint.

In a preferred embodiment, radius of curvature "R" is about 0.375 inches, and joint F has a length "L" of 1.75 inches. This means planar face 54,62 has a width of about 1.0 inches which is important for accommodating thermal expansion in a linear direction. The convex, concave, and planar joint surfaces have a height of about 1.75 inches with the convex and concave surfaces having a radius of 0.375 inches. Preferably, the strips are made from a graphite based composition with which the invention is particularly advantageous due to the anti-chipping nature of the joints.

EXAMPLE

The following is an example of the physical characteristics of a seal strip and end joint constructed according to the invention for purposes of illustration only, and not limitation:

| | Strips D | Strips E |
|---|---|---|
| Length | 48 inches | 48 inches |
| Width | .75 inches | 2.75 inches |
| Height | 1.75 inches | 1.75 inches |

In accordance with the invention, a method is disclosed for sealing the interface between a suction box and cylindrical shell of a papermaking machine suction roll as cylindrical shell rotates about the stationary suction box. The method includes forming a composite seal strip in edge slots constructed on edges of the suction box having a generally open-top U-shaped channel extending generally across the entire width of said suction box. The composite strip is formed by joining a plurality of elongated seal strips in the slots together end-to-end throughout the width of each slot. A lower edge of the seal strips are retained in the slots across the width of the suction box, and engage an upper edge of the seal strips. Next the method includes joining the seal strips together by correspondingly shaped convex radius surfaces and concave radius surfaces formed on first and second end sections near free ends of adjoining strips having a prescribed radius of curvature "R" which fit together. Thus, the convex and concave surfaces are used for forming interfitted radius joining the free ends together in opposition to the motion of rotation of said cylindrical shell. The method further contemplates the convex, concave, and planar surfaces being generally aligned with the channel of the suction box standing upwardly and having enlarged vertical and lateral extent to withstand shear forces on the ends of the seal strips as the cylindrical shell rotates against the wear surface of the seal strips forming the composite strip which reduces chipping and other joint damage preserving the seal integrity. Thermal expansion is accommodated according to the method by forming a planar surface between the radius surfaces having a linear extent parallel to the slot walls to accommodate thermal expansion of the strips composing the composite strip in the linear direction.

While a preferred embodiment of the invention has been described using specific terms, such description is for illustrative purposes only, and it is to be understood that changes and variations may be made without departing from the spirit or scope of the following claims.

What is claimed is:

1. In a papermaking machine suction roll, the improvement comprising in combination:

a stationary suction box;

a perforated cylindrical shell which rotates around said stationary suction box disposed centrally within said cylindrical shell, said suction box including slots constructed near at least two outside edges of said suction box extending across the width of said suction box, said slots including a pair of spaced apart opposing slot walls and integral bottom structure;

a composite seal strip of considerable length extending throughout the width of each slot;

a plurality of elongated generally rectangular seal strips included in said composite seal strip joined together end-to-end in said slots;

each strip received in said slot in an upstanding manner having an upper wear surface sealing against said rotating cylindrical shell and lower support surface received in said slot, and each strip further having a first end section and a second end section;

a plurality of joints spaced along the length of said composite sealing strip defined by ends of adjacent seal strips joined together;

each joint including a first end section of a first strip and a second end section of a second strip mated together in an abutting relation;

said first end section and second end section having interfitted radius surfaces which mate against each other against the rotation of said cylindrical shell; and planar joint surfaces interconnecting said radius surfaces of said first and second end sections of said interfitted ends accommodating thermal expansion of said individual seal strips in said composite strip in a linear direction.

2. The apparatus of claim wherein said individual seal strips and first and second end sections defining said joint structure are molded.

3. The apparatus of claim wherein said interfitted radius surfaces have a radius of curvature of about 0.375 inches.

4. The apparatus of claim 3 wherein said joints have a length of about 1.75 inches, and said planar joint surfaces have a width of about 1 inch.

5. The apparatus of claim 1 wherein said seal strips are constructed from a graphite based material.

6. In a papermaking machine suction roll, the improvement comprising in combination: a stationary suction box; a perforated cylindrical shell carried for rotation around said stationary suction box in a manner that suction applied to the interior of said suction box causes fluids to be drawn through said perforated cylindrical shell into said suction box, slots constructed near at least two outside edges of said suction box extending across the width of the suction box including a pair of spaced apart opposing generally parallel slot walls and integral bottom structure; a composite seal strip extending throughout the width of each slot which includes a plurality of individual elongated seal strips joined together end-to-end, each strip including an elongated generally rectangular strip having a length greater than a height, and said height being greater than a width of said rectangular strip, said rectangular strip having a lower edge on which said member stands in said slot with the height of said strip extending upwardly past the ends of said slot walls terminating in an upper edge having a wear surface which engages an interior surface of said rotating cylindrical shell to form a seal for effective suction of fluid through said perforated cylindrical shell into said suction box, each elongated rectangular seal strip having a first end section and a second end section; a joint formed between adjoining ends of said elongated rectangular strips forming said composite seal strips throughout the width of said suction box width including a first end section of a first strip and a second end section of a second strip in adjoining relation; said first end section including a first convex surface having a prescribed radius of curvature formed on a free end of said first strip, a first planar face generally parallel to said slot walls of said suction box integral with said first convex surface, and a first concave surface having said prescribed radius of curvature integral with said first planar surface; said second end section including a second convex surface having said prescribed radius of curvature formed on a free end of said second strip, a second planar face generally parallel to said slot walls of said suction box integral with said second convex surface, and a second concave surface having said prescribed radius of curvature integral with said second planar surface; and each said joint including said first and second convex surfaces mated with said second and first concave surfaces respectively, and said first and second planar surfaces mated together under the force of rotation of said rotating cylindrical shell.

7. The apparatus of claim 6 wherein said planar surfaces have a linear width which allows said mated planar joint surfaces to slide relative to each other for accommodating thermal expansion in a linear direction.

8. The apparatus of claim 6 wherein said first and second mated convex, concave, and planar surfaces of said joint have a height which extends generally from said lower edge of said seal strip to said upper wear surface of said seal strip above said slot walls, and said surfaces bearing and mating against one another in reaction and opposition to the rotation of said cylindrical shell to maintain the integrity of said joint.

9. The apparatus of claim 6 wherein said prescribed radius of curvature is about 0.375 inches.

10. The apparatus of claim 6 wherein said individual seal strips and first and second end sections structure are molded.

11. The apparatus of claim 10 wherein said seal strips are molded from a graphite based material.

12. In a papermaking machine having a stationary suction box and a perforated cylindrical shell which rotates around an interface with said suction box which is disposed cylindrically within said cylindrical shell, a method of sealing the interface between said suction box and cylindrical shell as said cylindrical shell rotates about said stationary suction box comprising:

forming a composite seal strip in edge slots constructed on edges of said suction box having a generally open-top U-shaped channel extending generally across the entire width of said suction box;

forming said composite strip by joining a plurality of elongated generally rectangular seal strips in said slots together end-to-end throughout the width of each slot;

retaining a lower edge of said seal strips in said slots across the width of said suction box, and engaging an upper edge of said seal strips having a wear surface against an interior surface of said cylindrical shell as it rotates about said suction box; and joining said seal strips together by correspondingly shaped convex surfaces and concave surfaces formed on first and second end sections near free ends of adjoining strips having a prescribed radius of curvature which fit together, said convex and concave surfaces forming an interfitted radius joining said free ends together in opposition to the motion of rotation of said cylindrical shell.

13. The method of claim 12 including aligning said convex, concave, and planar surfaces generally vertical and parallel with the channel of said suction box providing sufficient vertical and lateral extent to withstand shear forces on the ends of said seal strips as said cylindrical shell rotates against said wear surface of said seal strips forming said composite strip.

14. The method of claim 12 accommodating thermal expansion of said seal strips in said composite strip by forming a planar joint surface between said convex and concave surfaces which accommodate thermal expansion in a linear direction.

* * * * *